US009612075B1

(12) United States Patent
Stephens, IV

(10) Patent No.: US 9,612,075 B1
(45) Date of Patent: Apr. 4, 2017

(54) SELECTIVELY ENGAGEABLE AND REMOVABLE DUST COVER FOR A FIREARM

(71) Applicant: Loki Weapons Systems, LLC, Garner, NC (US)

(72) Inventor: Luther Wilson Stephens, IV, Garner, NC (US)

( * ) Notice: Subject to any disclaimer, the term of this patent is extended or adjusted under 35 U.S.C. 154(b) by 0 days.

(21) Appl. No.: 14/725,227

(22) Filed: May 29, 2015

(51) Int. Cl.
*F41A 35/02* (2006.01)
*F41A 9/54* (2006.01)

(52) U.S. Cl.
CPC ..... *F41A 35/02* (2013.01)

(58) Field of Classification Search
CPC .. F41A 35/02; F41A 35/00; F41A 9/54; F41A 9/55; F41A 9/56
See application file for complete search history.

(56) References Cited

U.S. PATENT DOCUMENTS 464,201 A * 12/1891 Rowland ..... A47K 10/22 16/229
1,904,110 A * 4/1933 Willmann ..... E05D 7/1005 16/229
2,186,789 A * 1/1940 Rosenberg ..... F24F 13/1426 126/285 R
2,926,382 A * 3/1960 Knese ..... E05D 7/10 16/261
3,369,316 A * 2/1968 Miller ..... F41C 23/04 42/72
3,671,998 A * 6/1972 Ruiz ..... E05D 7/1011 15/392
3,778,932 A * 12/1973 Ewing ..... E05D 7/1011 49/388
3,924,293 A * 12/1975 Cain ..... E05D 7/1011 16/229
4,332,515 A * 6/1982 Twyman ..... B63B 25/24 410/145
4,455,711 A * 6/1984 Anderson ..... E05D 7/1011 16/229
4,509,240 A * 4/1985 Tezuka ..... B25B 27/30 29/227
4,603,452 A * 8/1986 Paciorek ..... E05D 7/10 16/262

(Continued)

OTHER PUBLICATIONS

"Strike Industries QD Dust Cover for AR." YouTube. YouTube, Apr. 5, 2014. Web. Sep. 17, 2015. <https://www.youtube.com/watch?v=QjLHXIVFew8>.*

(Continued)

*Primary Examiner* — Derrick Morgan
(74) *Attorney, Agent, or Firm* — NK Patent Law, PLLC

(57) ABSTRACT

A dust cover for a firearm is provided. The cover includes a panel and a first extension extending from the panel and configured for engaging with the firearm to selectively secure the panel to the firearm. The panel is pivotable about the first extension to define a pivot point for pivoting the panel from a first position that encloses an opening or ejection port of the firearm and a second position in which the opening is not enclosed. The first extension is retractable relative to the panel to thereby allow for the selective engagement of the dust cover to the firearm. A related method of installing or replacing the dust cover is also provided.

7 Claims, 5 Drawing Sheets

(56) References Cited

U.S. PATENT DOCUMENTS 4,620,392 A * 11/1986 Kerpers ..... E05D 7/1011 16/229
5,016,949 A * 5/1991 Knurr ..... E05D 7/081 312/296
5,274,882 A * 1/1994 Persson ..... H04M 1/0216 16/229
5,722,121 A * 3/1998 Lau ..... E05D 5/128 16/381
5,845,366 A * 12/1998 Kuroda ..... G06F 1/1626 16/229
6,070,293 A * 6/2000 Schreiber ..... E05D 7/1011 16/229
D439,130 S * 3/2001 Ford ..... D8/329
6,438,800 B1 * 8/2002 Narang ..... E05D 7/1005 16/229
6,512,670 B1 * 1/2003 Boehme ..... G06F 1/1616 312/223.2
8,240,011 B2 * 8/2012 Chevrolet ..... A44C 5/14 24/265 B
8,272,101 B2 * 9/2012 Wagner ..... E05D 3/08 16/231
9,066,563 B2 * 6/2015 Chan ..... G04B 37/16
9,188,405 B2 * 11/2015 Hawley ..... F41A 35/02
2007/0033851 A1 * 2/2007 Hochstrate ..... F41A 5/18 42/75.01
2010/0101054 A1 * 4/2010 Cook ..... E05D 5/02 16/382
2011/0209607 A1 * 9/2011 St. George ..... F41A 3/26 89/191.01
2014/0196338 A1 * 7/2014 Lessard ..... F41A 3/66 42/16
2015/0285579 A1 * 10/2015 Hawley ..... F41A 35/02 42/96

OTHER PUBLICATIONS

"DOA Pinless Dust Cover." YouTube. YouTube, Mar. 9, 2015. Web. Sep. 17, 2015. <https://www.youtube.com/watch?v=zwrM0fwZyys>.*

"AR Enhanced Ultimate Dust Cover—223." AR Enhanced Ultimate Dust Cover—223. Oct. 22, 2014. Web. Sep. 17, 2015. <https://web.archive.org/web/20141022013914/http://www.strikeindustries.com/shop/index.php/rifle-accessories/ar/upper-parts/ar-enhanced-ultimate-dust-cover-223.html>.*

Strike Industries Ultimate Dust Cover, http://www.strikeindustries.com/shop/index.php/products/rifle-accessories/ar/upper-parts/ar-ultimate-dust-cover.html#.Vg6Ja5e8pCE, last accessed Oct. 2, 2015.

* cited by examiner

SELECTIVELY ENGAGEABLE AND REMOVABLE DUST COVER FOR A FIREARM

BACKGROUND

Field of the Invention

The present invention relates to a dust cover for a firearm. The dust cover encloses an opening such as an ejection port of the firearm. The dust cover is selectively engageable and removable such that the dust cover system can be removed for maintenance purposes such as replacement of broken springs that are used to bias the dust cover against the ejection port of the firearm.

Description of Related Art

Dust covers are used to cover the ejection port of a firearm. The cover is biased towards the firearm and pivots out of the way when a spent casing is ejected out of the ejection port.

The dust covers often break or have some other type of malfunction. For example, a torsional spring biases the dust cover towards the firearm to enclose the ejection port. However, the torsional spring undergoes significant stress due to the high ejection velocity of a spent cartridge and fatigues into failure often. When this occurs, the dust cover usually just pivots out of the way of the ejection port and is no longer functional.

Removal and replacement of the dust cover is difficult. The most common method involves using a punch to punch out a pin that engages the dust cover with the firearm and replacing with a new dust cover. The fail rate is high enough on the torsional springs that many users entirely remove the dust cover and use the firearm without any cover at all. This represents a safety and performance issue that is undesirable. Additionally, sometimes removal of the dust cover requires breakdown of other portions and parts of the firearm, further complicating the process.

BRIEF SUMMARY

According to one embodiment of the present invention, a dust cover for a firearm is provided. The cover includes a panel and a first extension extending from the panel and configured for engaging with the firearm to selectively secure the panel to the firearm. The panel is pivotable about the first extension to define a pivot point for pivoting the panel from a first position that encloses an opening or ejection port of the firearm and a second position in which the opening is not enclosed. The first extension is retractable relative to the panel to thereby allow for the selective engagement of the dust cover to the firearm.

According to one or more embodiments, the dust cover includes a second extension extending from an opposing side of the panel relative to the first extension.

According to one or more embodiments, the first extension is received within a recess defined in the firearm.

According to one or more embodiments, the first extension is retractable by translating a post extending from the first extension away from the recess.

According to one or more embodiments, the post extends through a slot defined in the cover.

According to one or more embodiments, the slot is made by removing material from the cover.

According to one or more embodiments, the second extension is retracted by translating a post extending from the second extension.

According to one or more embodiments, the first extension and the second extension collectively define the pivot point, and the first extension and the second extension are translatable in a direction along the pivot point.

According to one or more embodiments, the post of the first extension and the post of the second extension are squeezable by a user to retract both of the first extension and the second extension to allow removal of the cover relative to the firearm without the use of external tools.

According to one or more embodiments, the post of the first extension and the post of the second extension extend into the opening of the firearm when the cover is in the first position.

According to one or more embodiments, the first extension and the second extension are biased outwardly by at least one spring.

According to one or more embodiments, the dust cover includes a torsional spring for biasing the cover into the first position.

According to one or more embodiments, the dust cover includes at least one additional torsional spring for biasing the cover into the first position, wherein the at least one additional torsional spring extends along the pivot point and is defined within a cutout formed along the pivot point in the cover.

According to one or more embodiments, method of removing a dust cover from a firearm is provided. The method includes retracting a first extension extending from a panel of the dust cover and that is engaged with the firearm, retracting a second extension extending from the panel and that is engaged with the firearm, and translating the cover away from the firearm.

DETAILED DESCRIPTION

Representative examples of the inventions disclosed herein follow in the examples that follow. Interpretation of the scope of intellectual property afforded to this document shall be defined according to the claims that follow.

Figure 1:
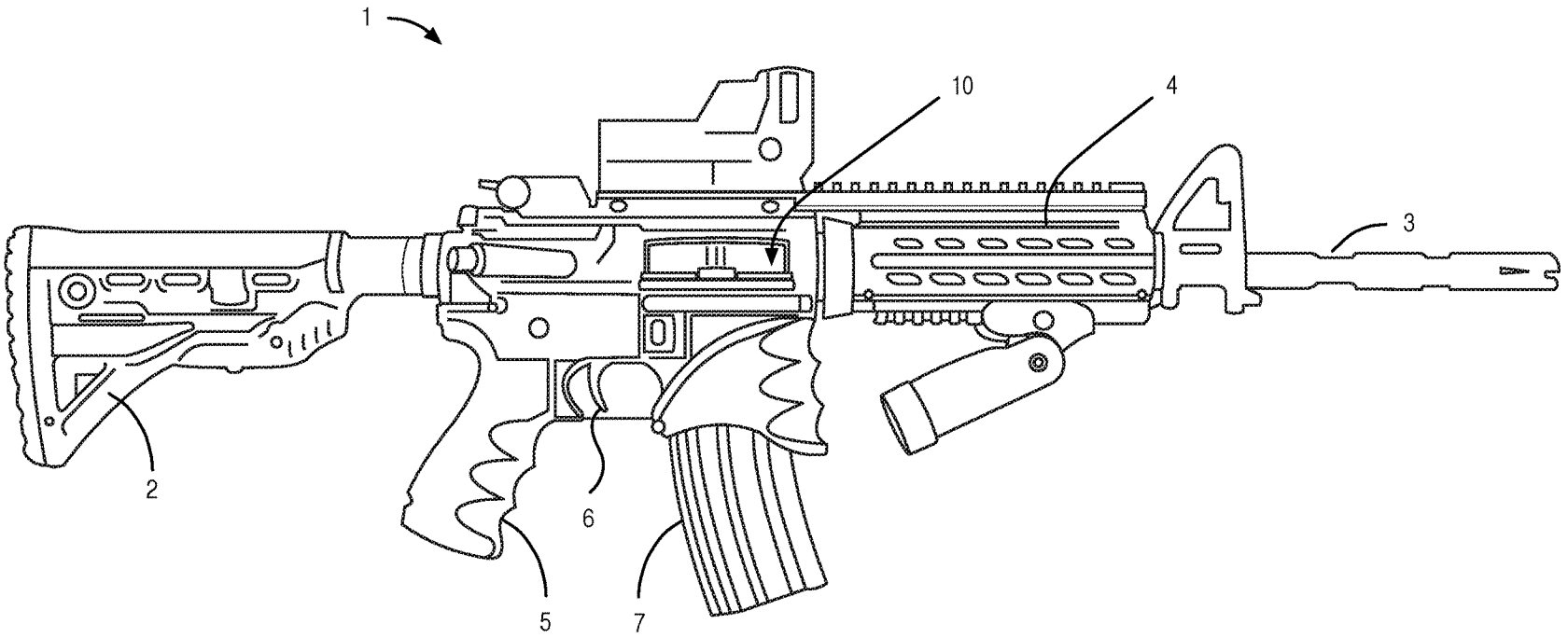
FIG. 1 illustrates a firearm having a selectively positionable dust cover according to one or more embodiments disclosed herein.
Figure 2:
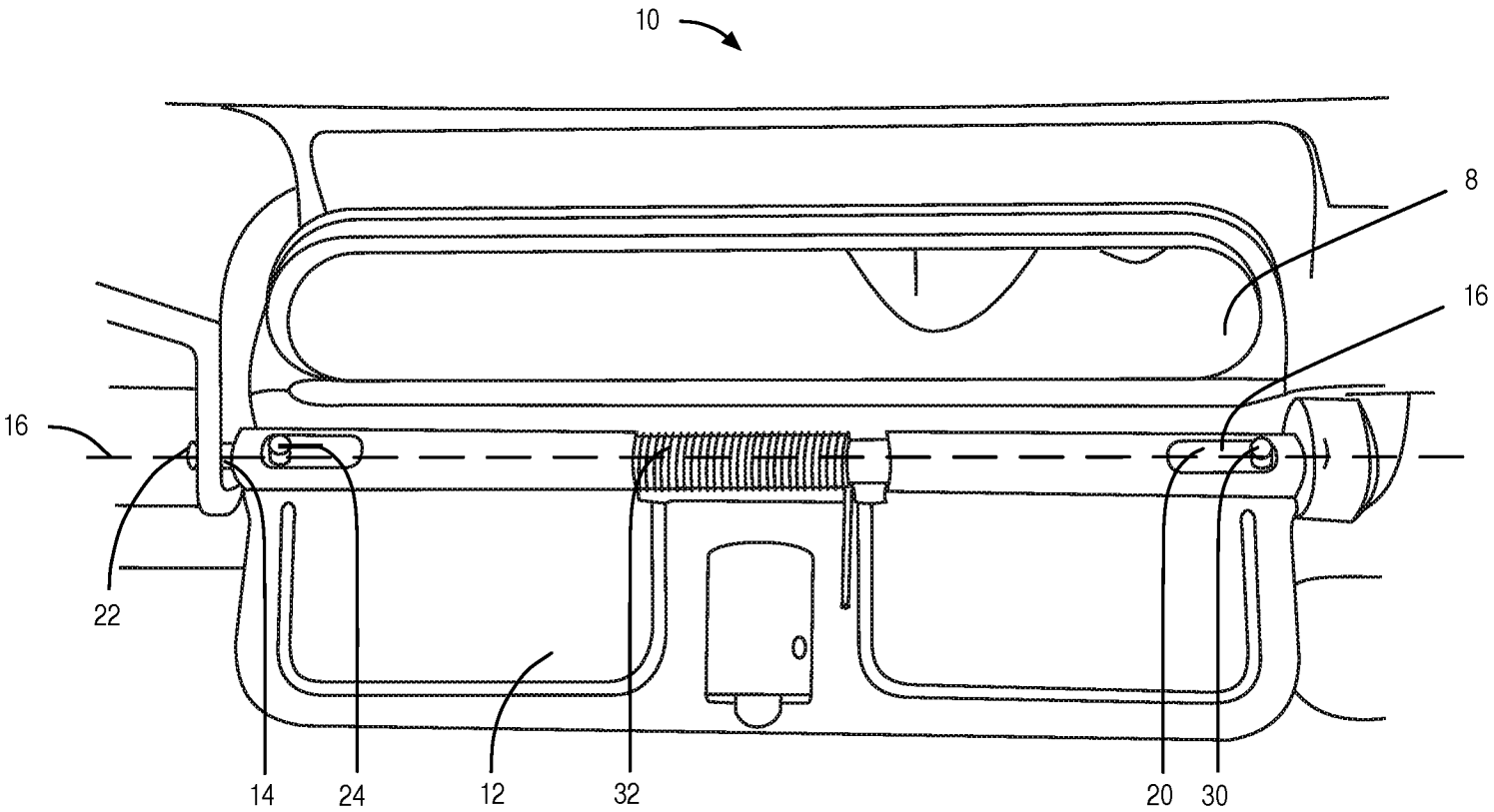
FIG. 2 illustrates the dust cover in a second position in which the ejection port is not covered according to one or more embodiments disclosed herein.
Figure 3:
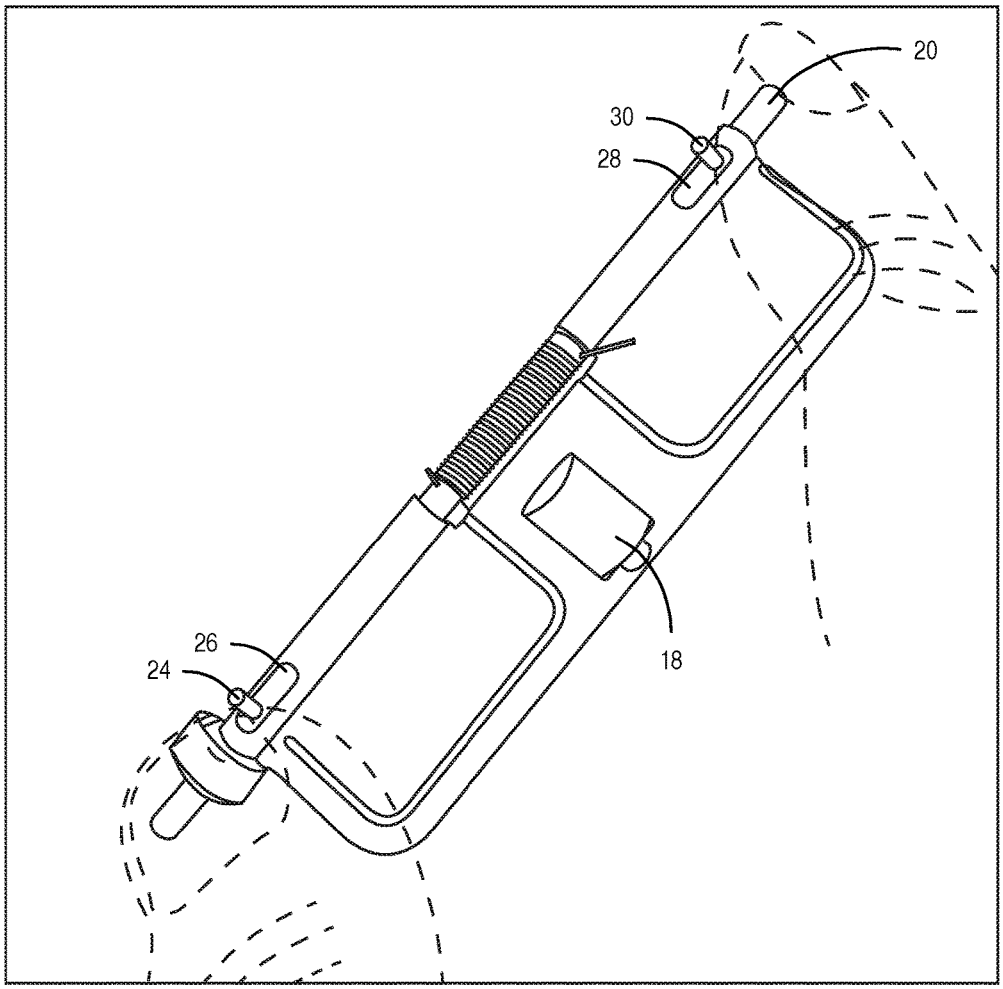
FIG. 3 illustrates posts engaged with retractable extensions being squeezed in order to effectuate removal of the dust cover according to one or more embodiments disclosed herein.
Figure 4:
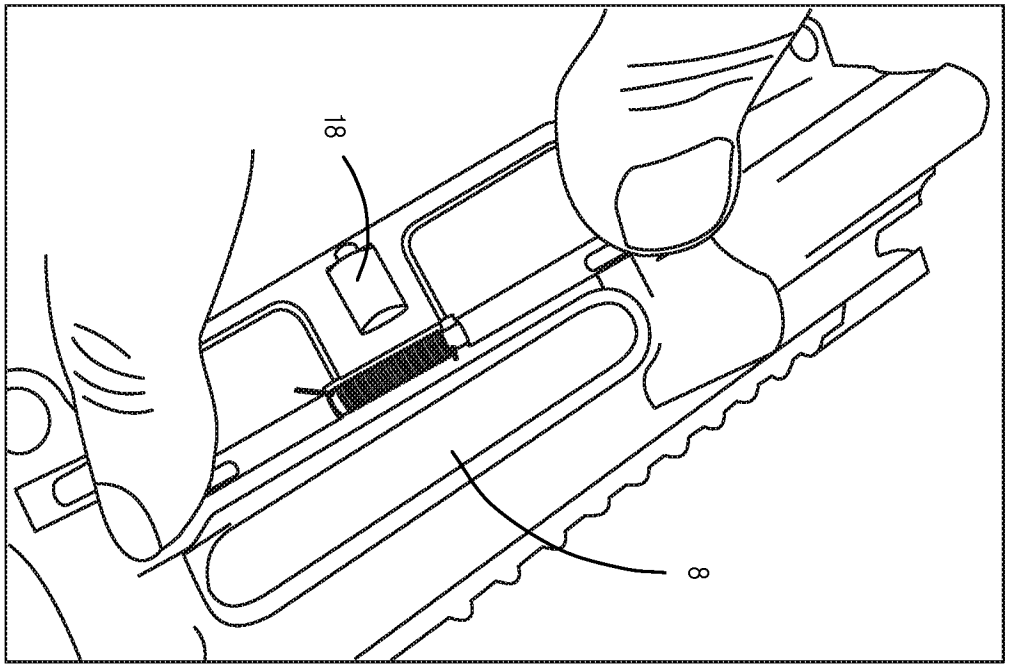
FIG. 4 illustrates the cover being translated away from the ejection port of the firearm.

A dust cover for a firearm is disclosed herein and is generally designated 10. The firearm illustrated is generally designated 1. An AR 15 firearm is depicted in FIG. 1 and throughout the remaining drawings, though any appropriately configured firearm may be provided. The firearm 1 includes a butt end 2 for being placed against a user, a barrel end 3, a forestock 4, a handle 5, trigger assembly 6, and magazine 7. With further reference to FIG. 2, the ejection port 8 is shown where the dust cover 10 has been pivoted into a second position in which the ejection port 8, sometimes referred to herein as an opening, is shown in an uncovered position. This occurs when a spent casing is ejected from the ejection port 8 after being fired.

The dust cover 10 includes a panel 12. The panel 12 as illustrated is similar to conventional panels in shape and size and is configured to enclose the ejection port 8. The panel 12 may be made of a metal, polymer, composite, or any other appropriately configured and selected material. The panel 12 may additionally be formed from a stamping, injection molding, or any other suitable manufacturing process. A first extension 14 extends from the panel 12 and is configured for engaging with the firearm 1 to selectively secure the panel 12 to the firearm 1 about the ejection port 8. The panel 12 is pivotable about the first extension 14 to define a pivot point or pivot line 16 for pivoting the panel 12 from a first position (as illustrated in FIG. 1) that encloses the ejection port 8 and a second position in which the ejection port 8 is not enclosed (as illustrated in FIG. 2).

In one or more embodiments, the first extension 14 is retractable relative to the panel 12 to thereby allow for the selective engagement of the dust cover 10 to the firearm 1. The selective engagement allows for repair and replacement of the dust cover 10 in times of repair or in any other situation. Situations outside of a repair situation might include the desire to go with a different weight dust cover, a different biasing spring force on the dust cover, and the like, and allowing easy repair and replacement of the dust cover 10 allows for such interchangeability. In one or more embodiments, the first extension 14 is received within a recess 22 defined in the firearm 1. As such, the first extension 14 defines a major outer dimension that is smaller than the dimension of the recess 22.

In one or more embodiments, a second extension 20 extends from an opposing side of the panel 12 relative to the first extension 14. As illustrated, the first extension 14 and the second extension 20 share a common axis and are generally aligned.

One or each of the first extension 14 and the second extension 20 may be retractable by translating a post extending from the first extension 14 and the second extension 20. Specifically, the first extension 14 may be translated by pressing on post 24 and sliding post 24 within a slot 26 defined in the cover 10. Similarly, the second extension 20 may be translated by pressing on post 30 and sliding post 30 within a slot 28 defined in the cover 10. Alternatively, the extensions 14, 20 may be translatable or retractable through other manners, such as with a magnet or other translation mechanism. Although illustrated where the posts 24, 30 point towards the ejection port 8 when in the first position, the posts 24, 30 could position outwardly of the ejection port 8 as well.

In one or more embodiments, each of slots 26 and 28 may be formed by removing material from a conventional cover system to allow retrofitting of the cover 10 to incorporate the slideable extensions disclosed herein. In this embodiment, extensions 14, 20 would be configured for translation as an aftermarket installation.

The first extension 14 and the second extension 20 collectively define the pivot point 14 about their shared common axis. Additionally, as illustrated and described, the first extension 14 and the second extension 20 are translatable in a direction along the pivot point 14. In one illustrative embodiment, the post 24 of the first extension 14 and the post 30 of the second extension 20 are squeezable by a user to retract both of the first extension and the second extension to allow removal of the cover relative to the firearm without the use of external tools. The post 24 of the first extension 14 and the post 30 of the second extension 20 extend into the ejection port 8 of the firearm 1 when the cover 10 is in the first position. The first extension 14 and the second extension 20 are biased outwardly by at least one spring.

Figure 5:
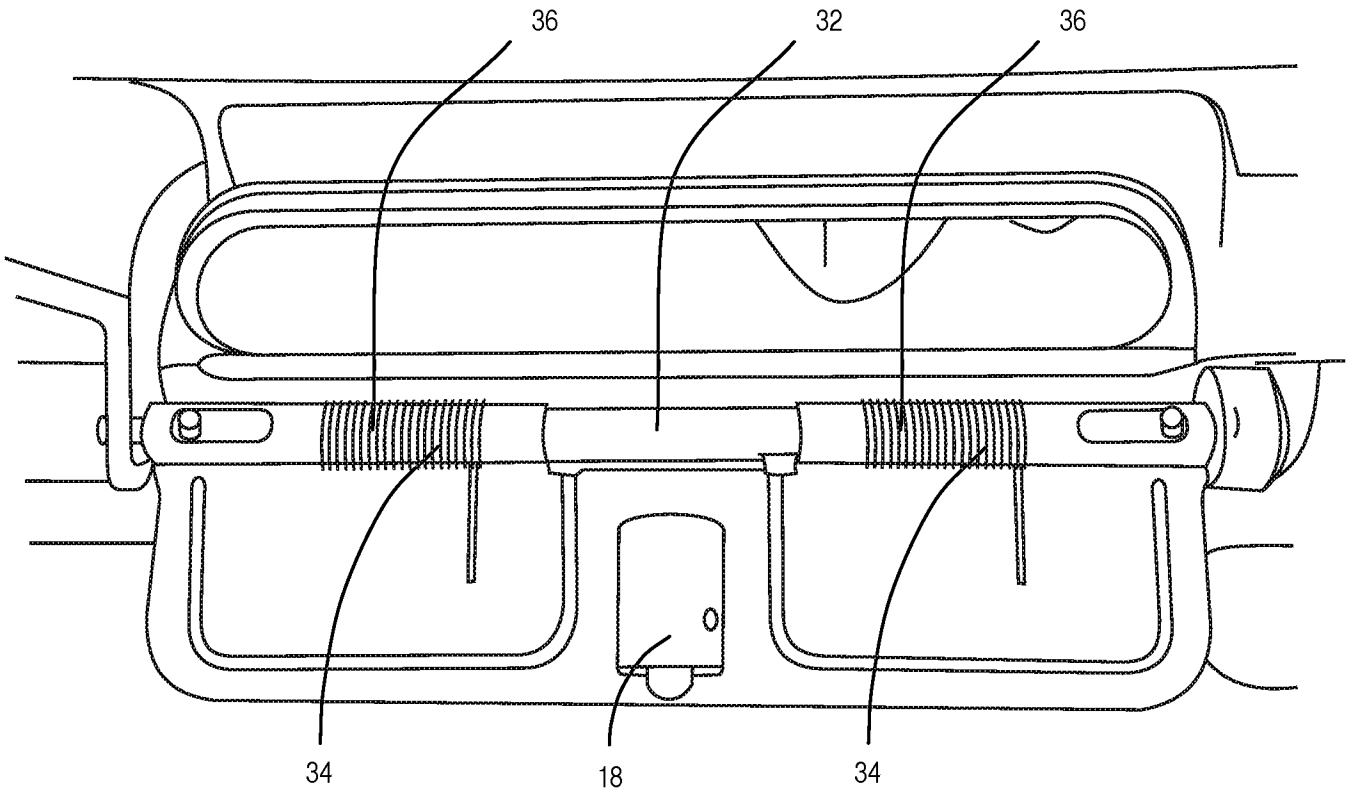
FIG. 5 illustrates an alternate embodiment of a dust cover according to one or more embodiments disclosed herein.

In at least one embodiment, a torsional spring 32 biases the cover 10 into the first position. In one or more additional embodiments illustrated in FIG. 5, at least one additional torsional spring 34 biases the cover 12 into the first position. The at least one additional torsional spring 34 extends along the pivot point and is defined within a cutout formed along the pivot point in the cover. In the embodiment illustrated in FIG. 5, the medially positioned torsional spring 32 may not be medially positioned and instead there may be two spaced-apart torsional springs.

One or more methods are disclosed herein. The methods may include removing the dust cover 10 from the firearm 1 where the method includes retracting the first extension 14 extending from the panel 12 of the dust cover 10 that is engaged with the firearm 1. The method also includes retracting the second extension 16 that extends from the panel and that is engaged with the firearm 1 and then translating the cover 10 away from the firearm 1.

One or more additional methods may provide for removing dust covers disclosed herein that are disposable in nature. For example, if a user wanted to remove the standard metal dust cover and replace with a composite cover or the like, the user would remove the standard cover by punching out the retaining extension or some other method. The user would then be able to install a new, alternate cover as disclosed herein according to the methods provided herein.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A dust cover for a firearm, comprising:

a panel; and a first extension and a longitudinally spaced-apart second extension, each of the first extension and the second extension configured to translate in a longitudinal direction relative to the panel, the first extension and the second extension extending from the panel and configured for engaging with the firearm to selectively secure the panel to the firearm, the panel being pivotable about the first extension and the second extension to define a pivot point for pivoting the panel from a first position that encloses an opening of the firearm and a second position in which the opening is not enclosed, a first post extending generally at a right angle from the first extension through a first slot defined in the panel and translatable with rotation of the panel such that rotation of the panel imparts a corresponding rotation to the first post that imparts a corresponding rotation of the first extension, wherein the first post engages terminally each end of the first slot when the first extension is translated along the longitudinal direction to thereby limit total translation of the first extension to maintain the first extension relative to the panel;

a second post extending generally at a right angle from the second extension through a second slot defined in the panel and translatable with rotation of the panel such that rotation of the panel imparts a corresponding rotation to the second post that imparts a corresponding rotation of the first extension, wherein the second post terminally engages each end of the second slot when the second extension is translated along the longitudinal direction to thereby limit total translation of the second extension to maintain the second extension relative to the panel;

wherein respective ends of the first post and the second post extend into a cavity of the firearm when the panel is closed against the firearm such that the first post and the second post cannot be gripped by a user when the panel is closed against the firearm and extend away from the firearm when the panel is pivoted about the pivot point to expose the cavity of the firearm, wherein the first extension and the second extension are retractable through translation relative to the panel to thereby allow for the selective engagement of the dust cover to the firearm by squeezing movement of the first post and the second post that imparts translation to the respective first extension and the second extension such that the panel can be removed without tools and translated away from the firearm at a right angle relative to a length of the firearm.

2. The cover according to claim 1, wherein the first extension is received within a recess defined in the firearm when the first extension is in an extended position.

3. The cover according to claim 1, wherein each of the slots are made by removing material from a conventional cover provided at the time of sale with the firearm.

4. The cover according to claim 1, wherein the first extension and the second extension collectively define the pivot point, and wherein the first extension and the second extension are translatable in a direction along the pivot point.

5. The cover according to claim 4, wherein the first extension and the second extension are biased outwardly.

6. The cover according to claim 1, further including a torsional spring for biasing the cover into the first position.

7. A method of removing a dust cover from a firearm, the method comprising:

retracting a first extension extending from a panel of the dust cover and that is engaged with the firearm;

retracting a second extension extending from the panel and that is engaged with the firearm, the second extension spaced-apart from the first extension, the first extension and the second extension extending from the panel and configured for engaging with the firearm to selectively secure the panel to the firearm, the panel being pivotable about the first extension and the second extension to define a pivot point for pivoting the panel from a first position that encloses an opening of the firearm and a second position in which the opening is not enclosed; and translating the cover away from the firearm, wherein a first post extends from the first extension and translatable with rotation of the panel such that rotation of the panel imparts a corresponding rotation to the first post that imparts a corresponding rotation of the first extension, wherein the first post terminally engages each end of the first slot when the first extension is translated along the longitudinal direction to thereby limit total translation of the first extension to maintain the first extension relative to the panel;

wherein a second post extends from the second extension and translatable with rotation of the panel such that rotation of the panel imparts a corresponding rotation to the first post that imparts a corresponding rotation of the first extension, wherein the second post terminally engages each end of the second slot when the second extension is translated along the longitudinal direction to thereby limit total translation of the second extension to maintain the second extension relative to the panel;

wherein the first post and the second post extend into a cavity of the firearm when the panel is closed against the firearm such that the first post and the second post cannot be gripped by a user when the panel is closed against the firearm and extend away from the firearm when the panel is pivoted about the pivot point to expose the cavity of the firearm, wherein the first extension and the second extension are retractable relative to the panel to thereby allow for the selective engagement of the dust cover to the firearm by squeezing movement of the first post and the second post that imparts movement to the respective first extension and the second extension such that the panel can be removed without tools and translated away from the firearm at a right angle relative to a length of the firearm.

* * * * *